US009157287B2

(12) United States Patent
Slocum et al.

(10) Patent No.: US 9,157,287 B2
(45) Date of Patent: Oct. 13, 2015

(54) SYSTEM AND METHOD FOR CONVEYING

(71) Applicant: Schlumberger Technology Corporation, Sugar Land, TX (US)

(72) Inventors: Alexander Slocum, Bow, NH (US); Keith Nelson, Sugar Land, TX (US); Irene Gabler, Sugar Land, TX (US); James Bayless, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 253 days.

(21) Appl. No.: 13/723,002

(22) Filed: Dec. 20, 2012

(65) Prior Publication Data

US 2014/0174760 A1 Jun. 26, 2014

(51) Int. Cl.
*E21B 23/00* (2006.01)
*E21B 4/18* (2006.01)

(52) U.S. Cl.
CPC . *E21B 23/00* (2013.01); *E21B 4/18* (2013.01); *E21B 2023/008* (2013.01)

(58) Field of Classification Search
USPC ..... 166/381, 241.1, 241.3; 405/184
See application file for complete search history.

(56) References Cited

U.S. PATENT DOCUMENTS

| | | | | |
|---|---|---|---|---|
| 4,192,380 | A * | 3/1980 | Smith | 166/254.2 |
| 4,610,317 | A | 9/1986 | England et al. | |
| 4,624,313 | A | 11/1986 | Coshow | |
| 4,846,290 | A | 7/1989 | Jones | |
| 5,184,676 | A | 2/1993 | Graham et al. | |
| 5,456,328 | A | 10/1995 | Saxman | |
| 6,003,606 | A | 12/1999 | Moore et al. | |
| 6,273,189 | B1 * | 8/2001 | Gissler et al. | 166/241.1 |
| 7,143,843 | B2 | 12/2006 | Doering et al. | |
| 7,185,714 | B2 | 3/2007 | Doering et al. | |
| 2010/0012135 | A1 | 1/2010 | Balletti et al. | |

FOREIGN PATENT DOCUMENTS

| | | | |
|---|---|---|---|
| EP | 1712685 | A1 | 10/2006 |
| WO | 2008091157 | A1 | 7/2008 |
| WO | 2008111844 | A1 | 9/2008 |

OTHER PUBLICATIONS

International Search Report and Written Opinion issued in PCT/US2013/073232 on Mar. 19, 2014; 13 pages.

* cited by examiner

*Primary Examiner* — William P Neuder
(74) *Attorney, Agent, or Firm* — Trevor Grove

(57) ABSTRACT

A technique facilitates conveyance of equipment along a wellbore or other tubular structure. A tractor is provided with a plurality of wheels oriented to engage a surrounding wall. Rotation of the wheels drives the tractor and causes longitudinal movement of the tractor with respect to the surrounding wall via a tangential force created between each wheel and the surrounding wall. Each wheel comprises teeth having a wheel tooth geometry which enhances cooperation with the surrounding wall. For example, the wheel tooth geometry may be designed to cooperate with the tangential force to push debris out of the teeth of each wheel during rotation of the wheel along the surrounding wall. In some applications, the wheel tooth geometry is designed to present a plurality of raised, rounded surfaces which engage the surrounding wall with a low stress impact.

9 Claims, 5 Drawing Sheets

SYSTEM AND METHOD FOR CONVEYING

BACKGROUND

In many well applications, tractors are employed to facilitate movement of equipment along a wellbore. A tractor may be connected to the well equipment in a manner such that the tractor acts against a surrounding wellbore wall to apply a force which moves the equipment in a desired direction along the wellbore. Many tractors are designed with driving wheels which rotate while gripping the surrounding wellbore wall to move the tractor. Such tractors may be employed in a variety of downhole environments, including oil well environments which have high concentrations of paraffin or wax content, large amounts of built up scale, or other types of debris. The debris found in wellbore environments tends to clog teeth on the driving wheels which reduces the gripping capability of the driving wheels. In some of these applications, the casing or other tubing against which the tractor acts to move the equipment may comprise plastic coatings that can be damaged by the tractor.

SUMMARY

In general, a system and methodology is provided for conveying equipment along a wellbore or other tubular environment. A tractor is provided with a plurality of wheels oriented to engage a surrounding wall, e.g. a surrounding wellbore wall. Rotation of the wheels drives the tractor and causes movement of the tractor with respect to the surrounding wall via a tangential force created between each wheel and the surrounding wall. Each wheel comprises teeth having a wheel tooth geometry designed to enhance cooperation with the surrounding wall. For example, the wheel tooth geometry may be designed to cooperate with the tangential force to push debris out of the teeth of each wheel during rotation of the wheel along the surrounding wall. In some applications, the wheel tooth geometry is designed to present a plurality of raised, rounded surfaces which engage the surrounding wall with a low stress impact.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
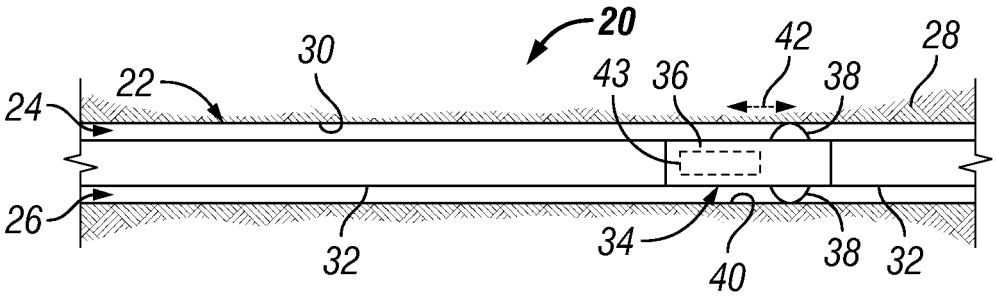
FIG. 1 is a schematic illustration of a system, e.g. a well system, comprising an embodiment of a tractor coupled into equipment conveyed along a surrounding wall, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for conveying equipment along a surrounding tubular structure, such as a wellbore. As explained in greater detail below, the system and methodology are designed to utilize a tractor or tractors to convey equipment along the interior of a tubular structure by engaging the surrounding wall of the tubular structure. The tractor comprises a plurality of wheels which are oriented to grip the surrounding wall and to establish a tangential force which is used to facilitate movement of equipment along the interior of the tubular structure. In wellbore applications, the tractor may be employed to convey equipment along an open wellbore, along the interior of a casing, and/or along the interior of another tubular structure.

According to an embodiment, a well system comprises a tubing string having a tractor with wheels oriented to engage the surrounding wellbore wall and to move the tubing string along a wellbore. Each wheel of a plurality of the wheels comprises teeth designed to automatically remove debris by using the tangential and radial forces established between the wheel and the surrounding wellbore wall during operation of the tractor via rotation of the wheel. The debris removal continues automatically as the wheels are rotated along the surrounding wellbore wall, thus providing a self-cleaning tractor system. For example, the teeth may be designed with a wheel tooth geometry that cooperates with the tangential force to push debris laterally with respect to the direction of tractor movement and thus out of the teeth during rotation of the wheel along the surrounding wellbore wall. The wheel tooth geometry also may be designed to accomplish additional or other results, such as limiting the stress impact caused by engagement of the teeth with the surrounding wellbore wall.

By way of example, the debris may be removed by establishing a tangential shearing force at the interface between the surrounding wall, e.g. the surrounding wellbore casing or other wellbore wall, and the tractor wheel. The tangential force is the force that provides the tractor with its forward momentum to move, and this force also can be harnessed to remove debris from the teeth of the tractor wheels. Generally, tractor teeth interact with the surrounding wall to create a shear area, and this shear area is designed with sufficient size and configuration to minimize detrimental effects with respect to the surrounding wall. However, as the tractor wheel teeth become filled with debris, wheel grip can be lost even if the normal force applied to the wellbore wall by the wheel is increased. The design of the wheel teeth described herein enable continual removal of the debris to maintain the desired grip between the tractor wheels and the surrounding wall, e.g. the surrounding wellbore wall.

In various applications, the teeth of a plurality of the tractor wheels are designed to reduce accumulation of debris in the root or base of the teeth so as to provide the above-described, self-cleaning effect. Embodiments described herein use the tangential and radial forces created between the wheels and the surrounding wellbore wall in combination with the wheel tooth geometry to push debris out of the root of the teeth. For example, the teeth of each wheel may be oriented in a non-parallel relationship with respect to a rotational axis of the wheel. In other words, the root and/or sides of the teeth are arranged at an angle, i.e. a non-zero angle, with respect to the rotational axis of the wheel. This angular orientation causes the shear zone behind each tooth to "push" or to compact debris/material behind the tooth with a side load, and this side load causes an ejection of material from the tooth root. During each tooth cycle interaction with the surrounding wall, the debris is compacted with side loading and this continued action automatically "pushes" debris in a lateral direction and out of the wheel teeth.

Referring generally to FIG. 1, an embodiment of a system for conveying equipment along a tubular structure is illustrated. By way of example, the system may comprise a well system deployed downhole in a wellbore for performance of a well related operation, such as a well treatment operation, a well service operation, a well production operation, and/or another well related operation. The system comprises at least one tractor which facilitates movement of equipment along the surrounding wall. In well applications, the system may comprise many types of components and may be employed in many types of applications and environments, including cased wells and open-hole wells. While the term 'tubular' has been used hereinabove and hereinbelow, those skilled in the art will appreciate that the tubular may be more oval in cross-section than circular in cross-section (such as when a wellbore has been washed out or the like), while remaining within the scope of the present disclosure. The well system also may be utilized in vertical wells and deviated wells, e.g. horizontal wells.

Referring again to FIG. 1, a schematic example of a system 20, e.g. a well system for use in a well 22, is illustrated. Well 22 may comprise a production well for producing a desired fluid, e.g. gas or oil; well 22 may comprise an injection well for injecting a desired fluid, e.g. gas or water; and/or well 22 may comprise a variety of other types of wells. In the example illustrated, well system 20 comprises a well string 24 deployed in a wellbore 26 which extends through a formation 28. In some applications, the wellbore 26 is lined with a casing 30, although the well string 24 may be deployed in an open wellbore. The well string 24 may comprise a variety of well equipment 32, e.g. well servicing and/or production system strings, which are conveyed along the wellbore 26 via at least one tractor 34.

In the example illustrated, tractor 34 comprises a tractor body 36 and a plurality of wheels 38 rotatably mounted to the tractor body 36. The wheels 38 serve as driving wheels to move tractor 34 and well equipment 32 along wellbore 26. The number of wheels 38 may vary depending on the design of a specific tractor 34. In some designs, for example, a plurality of wheels 38 may be distributed circumferentially around the tractor 34 at an individual longitudinal location or at a plurality of longitudinal locations along the tractor 34. The tractor wheels 38 are oriented to extend radially outward from the tractor body 36 and to engage a surrounding wall 40. By way of example, the surrounding wellbore wall 40 may comprise an open wellbore wall, an interior of casing 30, or a wall of another type of surrounding tubular structure.

The wheels 38 are selectively rotated to move the tractor 34 longitudinally with respect to the surrounding wellbore wall 40. The longitudinal movement is caused by creation of a tangential force 42 which acts between each wheel 38 and the surrounding wellbore wall 40. The tangential force 42 results from the gripping action of each wheel 38 as it engages and rotates against the surrounding wellbore wall 40. It should be noted that rotation of wheels 38 is controlled by a motive source 43, such as a hydraulic or electromechanical motive source. The motive source 43 can be operated via a variety of methods understood by those of ordinary skill in the art, including hydraulic actuation, electromechanical actuation, and/or other suitable types of actuation which can rotate wheels 38, drive tractor 34, and convey equipment 32 along wellbore 26.

Figure 2:
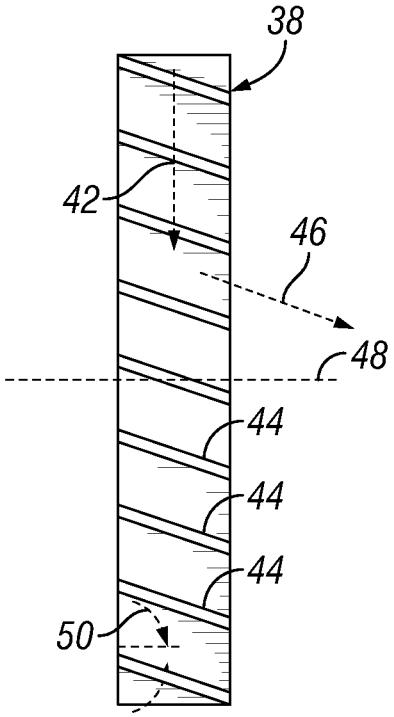
FIG. 2 is a schematic illustration of an embodiment of a tractor driving wheel, according to an embodiment of the disclosure.
Figure 3:
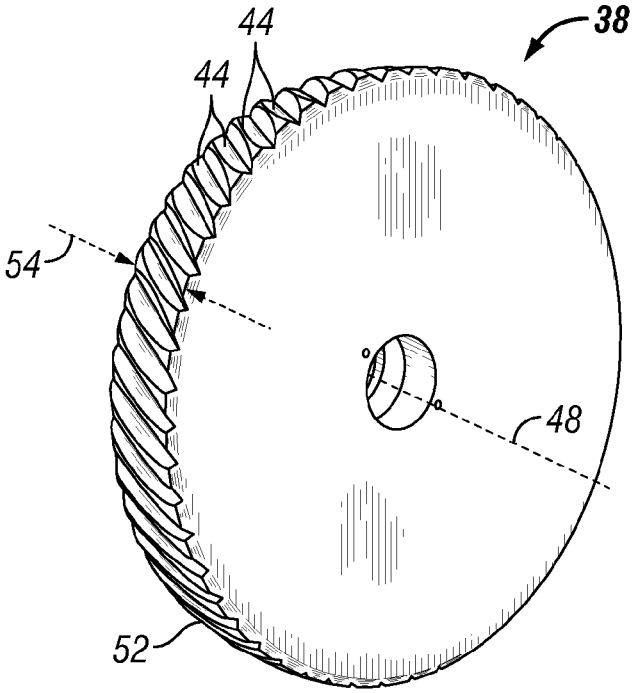
FIG. 3 is an orthogonal view of an embodiment of a tractor driving wheel, according to an embodiment of the disclosure.

Referring generally to FIG. 2, a schematic illustration is provided of an individual wheel 38 having a plurality of teeth 44 arranged to cooperate with the tangential force 42 in a manner which creates a side load, as indicated by arrow 46. It should be noted that engagement of the wheel 38 with the surrounding wall 40 also creates a radial force acting in a radial direction with respect to the wheel 38. In some embodiments, the side load 46 is established by orienting teeth 44 in a non-parallel relationship with a rotational axis 48 of the wheel 38. For example, the teeth 44 may be oriented at an angle 50, i.e. a non-zero angle, with respect to the rotational axis 48. This orients side load 46 at a non-perpendicular angle with respect to the tangential load 42. In FIG. 3, for example, teeth 44 have their sides oriented at angle 50 along the overall circumference 52 of wheel 38 with each tooth 44 extending at least substantially through a width 54 of the wheel 38.

Figure 4:
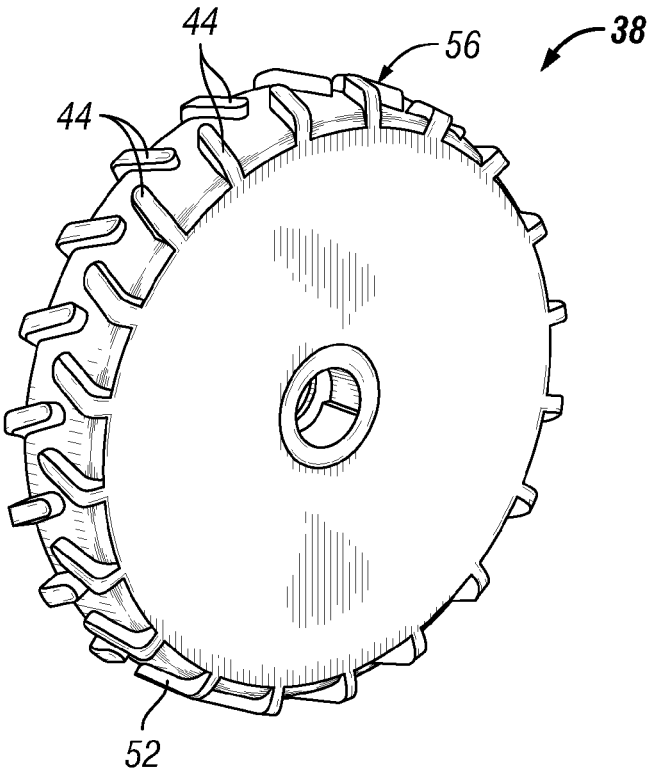
FIG. 4 is an orthogonal view of another embodiment of a tractor driving wheel, according to an embodiment of the disclosure.

In another example, the teeth 44 are arranged in an alternating angular pattern in which some teeth 44 are oriented at a different angle with respect to rotational axis 48 then other teeth 44, as illustrated in FIG. 4. By way of specific example, the alternating angular pattern may be established by forming the teeth 44 with a generally square cross-section to establish a square tooth tread pattern 56. The illustrated square tooth tread pattern 56 orients the teeth 44, e.g. the sides of teeth 44, in an alternating pattern to eject debris laterally to both sides of the wheel 38.

Figure 5:
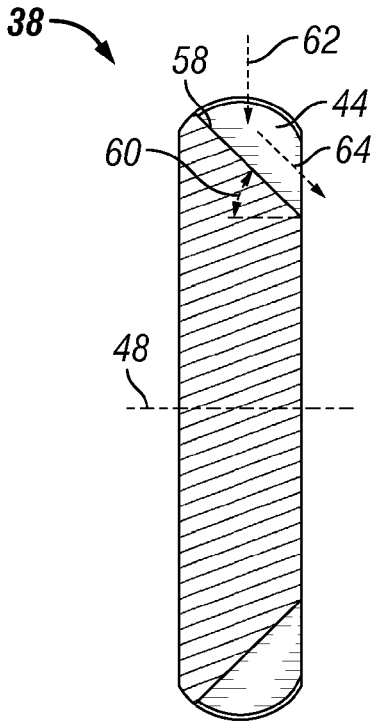
FIG. 5 is a schematic, cross-sectional illustration of another embodiment of a tractor driving wheel, according to an embodiment of the disclosure.
Figure 6:
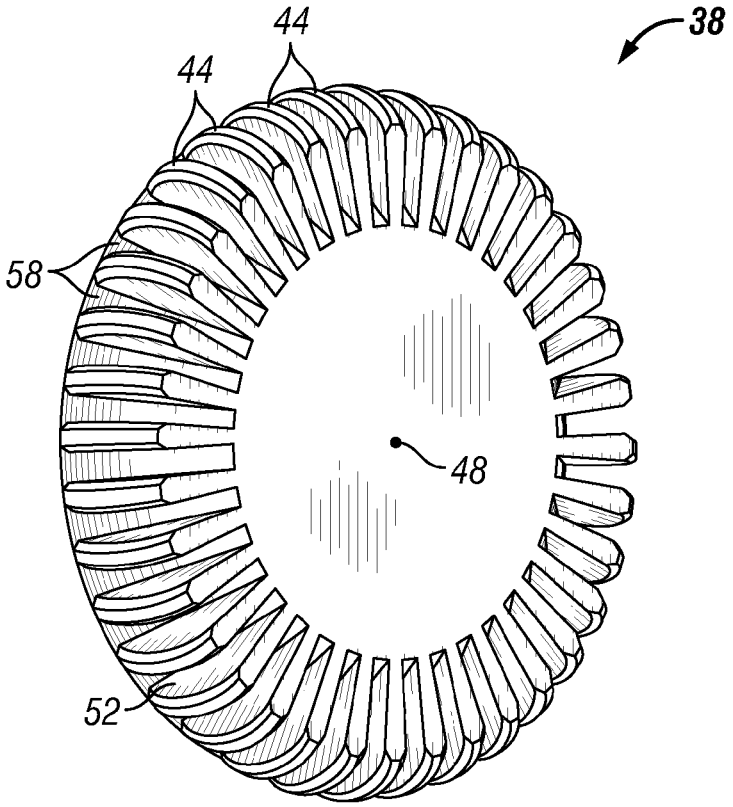
FIG. 6 is an orthogonal view of an embodiment of a tractor driving wheel similar to that illustrated in FIG. 5, according to an embodiment of the disclosure.

Referring generally to FIGS. 5 and 6, another embodiment of wheel 38 is illustrated. In this embodiment, the debris discharging effect of the wheel 38 is further enhanced by changing a root 58 of the teeth from being parallel with axis 48 to a non-parallel angle 60 with respect to axis 48, as best illustrated in FIG. 5. Angle 60 is selected such that the plane of root 58 causes debris/material to be pushed or compacted out of the teeth 44. Tangential and radial forces acting on wheel 38 induce the side loading which effectively cleans teeth 44.

For example, creation of tangential force 42 by engaging the wheel 38 with the surrounding wellbore wall 40 also causes a radial force represented by arrow 62. These forces tend to move the material/debris along the angled plane of root 58, as indicated by arrow 64. It should be noted both tangential forces 42 and radial forces 62 are created for wheels 38 in each of the embodiments described herein when the wheels 38 engage the surrounding wall 40 to move the tractor 34 in a desired longitudinal direction with respect to the surrounding wall 40. Depending on the parameters of a given application, the teeth 44 may be angled by orienting the sides of teeth 44 at an angle with respect to axis 48; by orienting the root 58 of the teeth at an angle with respect to axis 48; or by orienting both the sides of teeth 44 and the root 58 of teeth 44 at angles with respect to axis 48.

Figure 7:
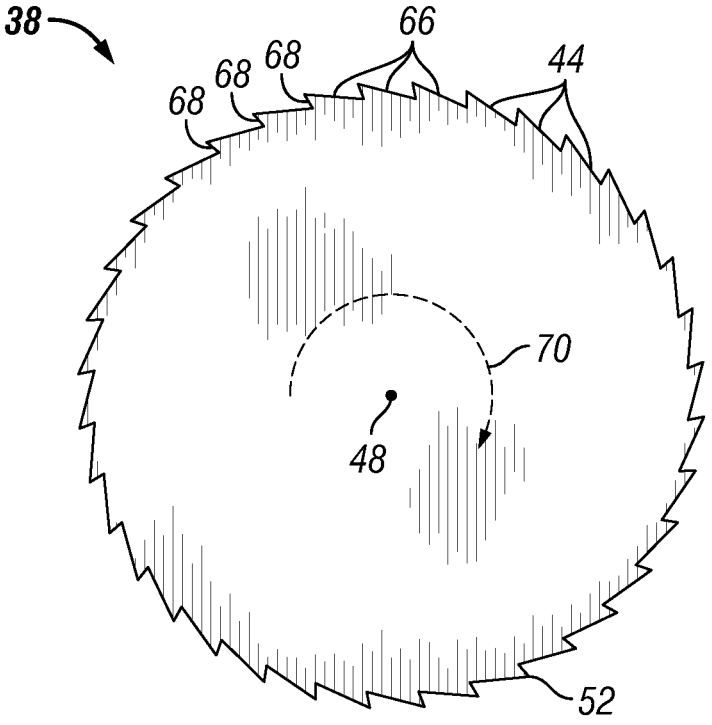
FIG. 7 is a schematic, cross-sectional illustration of another embodiment of a tractor driving wheel, according to an embodiment of the disclosure.
Figure 8:
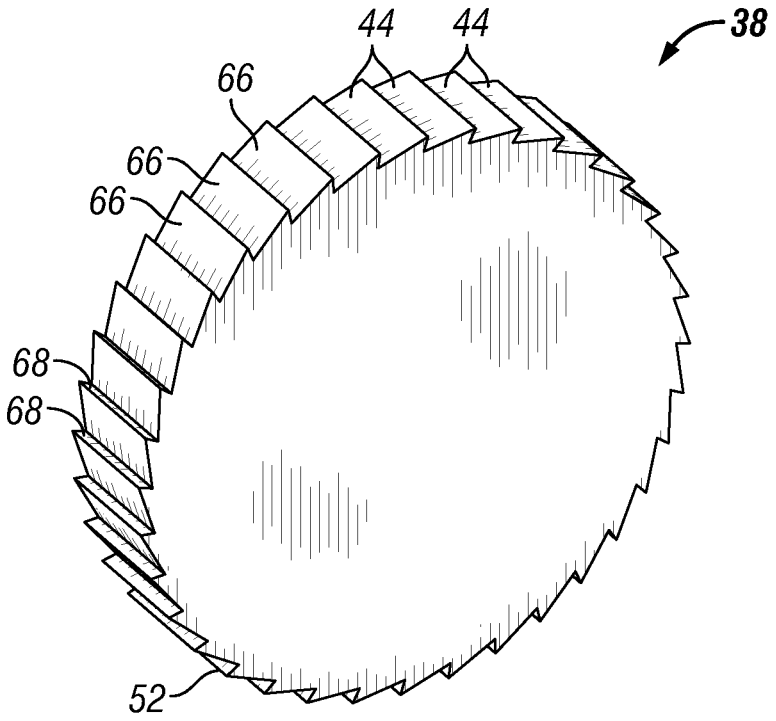
FIG. 8 is an orthogonal view of an embodiment of a tractor driving wheel similar to that illustrated in FIG. 7, according to an embodiment of the disclosure.

Referring generally to FIGS. 7 and 8, another embodiment of wheel 38 is illustrated. In this embodiment, the teeth 44 are designed as non-symmetrical sloping teeth. For example, each tooth 44 may have a longer lead surface 66 compared to a trailing surface 68. Lead surface 66 is positioned to engage the surrounding wall 40 when the wheel 38 is rotated in a rotational direction indicated by arrow 70 in FIG. 7.

In this example, the back side of each tooth 44 is represented by trailing surface 68 and is designed to minimize the scooping action of the tooth. This, in turn, reduces the debris picked up by the teeth 44 as the wheel 38 grips and rolls along the surrounding surface 40. As each wheel 38 rolls out of the contact area with the surrounding wall 40, the direction of the wheel and the non-symmetrical angle of the teeth 44 create a pushing effect which pushes debris/material off of teeth 44 as those teeth move out of the contact area.

Figure 9:
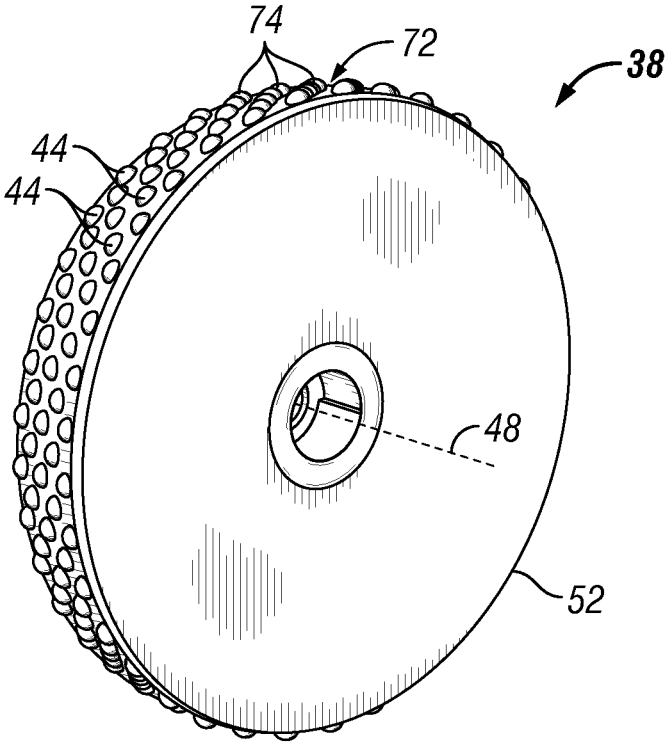
FIG. 9 is an orthogonal view of another embodiment of a tractor driving wheel, according to an embodiment of the disclosure.
Figure 10:
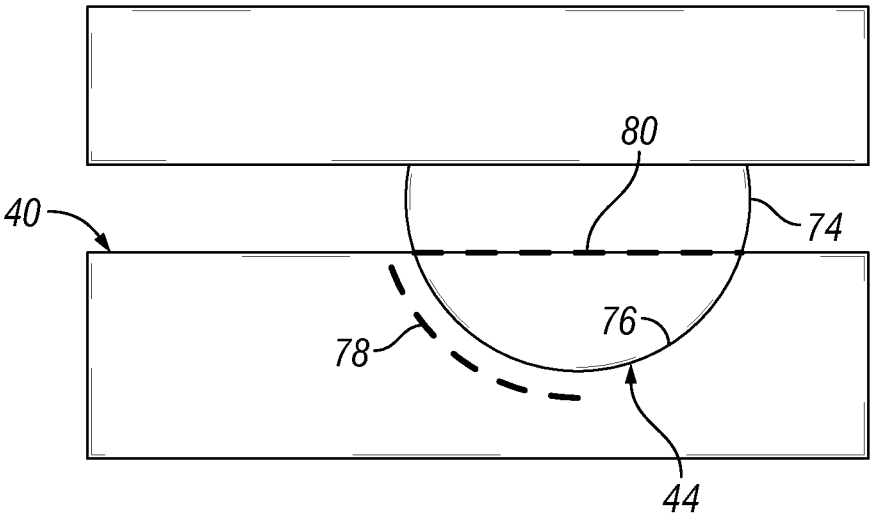
FIG. 10 is a schematic illustration of the wheel tooth geometry employed on the tractor driving wheel illustrated in FIG. 9, according to an embodiment of the disclosure.

Referring generally to FIGS. 9 and 10, another embodiment of wheel 38 is illustrated. In this embodiment, teeth 44 are designed to create a wheel tread 72 which exerts a low stress impact on the surrounding wall 40, e.g. the surrounding wellbore wall 40, during operation of tractor 34. The low stress impact wheel tread 72 is useful in a variety of applications, including applications in which the material forming surrounding surface 40 may be easily chipped, punctured, or otherwise damaged. For example, the wheel tread 72 is useful when used in well related, tubular structures which have a plastic internal coating or another type of soft internal coating. The design of the individual teeth also may be selected to provide teeth which are stronger than conventional teeth.

By way of example, the teeth 44 used to establish wheel tread pattern 72 may be designed with a wheel tooth geometry that presents a plurality of raised, rounded surfaces 74 oriented to engage the surrounding wellbore wall 40 with a low stress impact. (See, for example, FIG. 10). As illustrated best in FIG. 9, the tread pattern 72 may comprise a plurality of the raised, rounded surfaces moving across the width 54 of the wheel 38 and along the length or circumference 52 of the wheel 38. In some applications, the raised, rounded surfaces 74 of teeth 44 may be spherically shaped in that each rounded surface forms part of a sphere. Effectively, the teeth 44 are constructed as a plurality of rounded, e.g. spherical, nubs or nodules which extend outwardly from the circumference of the wheel 38. Use of the spherically shaped teeth 44 prevents formation of inconsistencies along the surrounding wall 40 which, in turn, prevents initiation of points for pitting, corrosion and/or fatigue cracking.

By way of example, some well applications utilize tubing or drill pipe with internal plastic coatings to increase production flow rates and corrosion resistance with respect to production fluids. The tread pattern 72 and the raised, rounded surfaces 74 reduce deleterious removal of the plastic coating or other type of softer coating during operation of the tractor 34. The rounded surfaces 74 create spherical or otherwise rounded, dimpled impressions 76 which have a lower stress impact on the surrounding surface 40. Spherical dimples, for example, are low stress features because the stresses moving through the casing or other type of surrounding wall 40 tend to move around the dimpled impressions 76. The roundness of the dimpled impressions 76 reduces or prevents formation of sharp corners in the material that could otherwise initiate fatigue or stress crack corrosion issues. By adjusting the diameter and penetration depth of the rounded surfaces 74, the low stress effect can be enhanced to ensure minimal damage to the casing or other type of surrounding surface 40.

Additionally, when surrounding surface 40 comprises plastic or other soft material, the rounded surfaces 74 of teeth 44 create a larger shear area during the gripping process as tractor 34 moves along the surrounding surface 40. This is beneficial to the conveying process when the shear strength of the softer material is significantly less than that of the material, e.g. steel, used to form wheels 38 and wheel tread pattern 72. The rounded, e.g. spherical, shape of the teeth 44 creates a bearing area 78 which is substantially longer to spread out the forces and to reduce the stress loading. Additionally, the larger cross-section 80 of each rounded tooth 44 provides a stronger gripping tooth having an increased tooth shear area. In some applications, the wheel tread pattern also is arranged to provide the self-cleaning action described above.

The overall system 20 may be constructed to accommodate a variety of operations in well related applications and non-well related applications. Accordingly, the tractor 34 may be designed to move equipment through many types of tubular structures in a variety of environments. Depending on the size, weight and configuration of the equipment, an individual tractor may be employed, or a plurality of tractors may be used in combination.

The tractor also may be designed in a variety of configurations and with many types of suitable materials. For example, the tractor may be sized for use within a well casing or other tubular well surface. Each tractor may be operated hydraulically, electrically, or via other suitable techniques for energizing the tractor and for rotating the tractor wheels to cause motion along the interior of the wellbore or other tubular structure. In some applications, the tractor may have a plurality of wheel sets located along the length of the tractor, or a plurality of wheels may be used in conjunction with other motive mechanisms operated to cause relative motion of the tractor with respect to the surrounding wall.

Depending on the parameters of a given application, the wheel teeth also may have a variety of numbers, configurations, and/or patterns. The various types and arrangements of teeth described above may be used individually or in combinations. Additionally, the tractors may be designed such that some of the wheels contain teeth as described above, while other wheels comprise more conventional types of teeth. The wheel construction and the materials used to form the wheels also may be selected according to the environmental and operational parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for conveying along a wellbore, comprising:

a tractor having a plurality of wheels oriented to engage a surrounding wellbore wall such that rotation of the plurality of wheels causes movement of the tractor with respect to the surrounding wellbore wall via a tangential force and a radial force created between each wheel and the surrounding wellbore wall, each wheel comprising teeth having a wheel tooth geometry which cooperates with the tangential force and the radial force to push debris out of the teeth during rotation of the wheel along the surrounding wellbore wall, wherein the teeth of each wheel: are oriented in an alternating angular pattern, are arranged in a square tooth tread pattern oriented to eject debris laterally to both sides of the wheel, are mounted on a slanted root oriented at a non-parallel angle with respect to a rotational axis of the wheel, are mounted on a slanted root oriented at a non-parallel angle with respect to a rotational axis of the wheel, comprise non-symmetrical sloping teeth, or combinations thereof.

2. The system as recited in claim 1, wherein the teeth of each wheel are oriented in a non-parallel relationship with a rotational axis of the wheel.

3. The system as recited in claim 1, wherein the teeth of each wheel are oriented at an angle with respect to the rotational axis of the wheel.

4. The system as recited in claim 1, wherein the teeth of each wheel comprise teeth individually formed as a portion of a sphere.

5. A method for conveying equipment along a wellbore, comprising:

coupling well equipment to a tractor having a plurality of wheels positioned to engage a wellbore wall via a plurality of teeth mounted on each wheel;

rotating the plurality of wheels to establish a tangential force acting between each wheel and the wellbore wall; and using the tangential force to remove debris from between teeth of the plurality of teeth, wherein using comprises orienting teeth of the plurality of teeth on each wheel at a plurality of different angles, orienting teeth of the plurality of teeth on each wheel in an alternating angular pattern, orienting teeth of the plurality of teeth on each wheel in a square tooth tread pattern arranged to eject debris laterally to both sides of the wheel, using teeth mounted on a slanted root which is arranged in a non-parallel orientation with respect to a rotational axis of the wheel, orienting teeth of the plurality of teeth in a non-symmetrical sloping arrangement, using a pattern of generally spherically shaped nubs to form the plurality of teeth, or combinations thereof.

6. The method as recited in claim 5, wherein using comprises orienting the plurality of teeth at a non-perpendicular angle with respect to the tangential force.

7. The method as recited in claim 5, wherein using comprises orienting the plurality of teeth of each wheel in a non-parallel relationship with a rotational axis of the wheel.

8. A system for conveying along a wellbore, comprising:

a tractor having a plurality of wheels oriented to engage a surrounding wellbore wall such that rotation of the plurality of wheels causes movement of the tractor with respect to the surrounding wellbore wall, each wheel of the plurality of wheels comprising teeth having a wheel tooth geometry which presents a plurality of raised, rounded surfaces oriented to engage the surrounding wellbore wall with a low stress impact, wherein each raised, rounded surface forms part of a sphere.

9. The system as recited in claim 8, wherein each wheel comprises a plurality of the raised, rounded surfaces across the width of the wheel and along the length of the wheel.

* * * * *